US009611723B2

(12) United States Patent
Chochua et al.

(10) Patent No.: US 9,611,723 B2
(45) Date of Patent: Apr. 4, 2017

(54) HEAT TRANSFERRING ELECTRONICS CHASSIS

(71) Applicant: Schlumberger Technology Corporation, Sugar Land, TX (US)

(72) Inventors: Gocha Chochua, Sugar Land, TX (US); Muralidhar Seshadri, Stafford, TX (US); Ke Ken Li, Missouri City, TX (US); Christopher Aumaugher, Houston, TX (US); Melvin Bryan, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 78 days.

(21) Appl. No.: 14/574,362

(22) Filed: Dec. 17, 2014

(65) Prior Publication Data

US 2016/0183404 A1 Jun. 23, 2016

(51) Int. Cl.

| | |
|---|---|
| ***H05K 7/20*** | (2006.01) |
| ***E21B 41/00*** | (2006.01) |
| ***E21B 47/01*** | (2012.01) |

(52) U.S. Cl.

CPC ..... *E21B 41/00* (2013.01); *E21B 47/01* (2013.01); *E21B 47/011* (2013.01)

(58) Field of Classification Search

CPC . G06F 1/181–1/182; H05K 7/20218–7/20381; H05K 7/20409–7/20418; H05K 7/20009–7/202; H01L 23/367–23/3677; H01L 23/473; H01L 23/46–23/467; E21B 41/00

USPC ..... 361/676–678, 679.46–679.54, 688–723, 361/756, 741, 686, 687, 725, 787, 789, 361/794, 807–810; 165/80.1–80.5, 165/104.33, 185; 174/15.1–15.3, 174/16.1–16.3, 547, 548; 257/712–722, 257/E23.088; 24/453, 458–459; 454/184; 312/236

See application file for complete search history.

(56) References Cited

U.S. PATENT DOCUMENTS 4,407,136 A * 10/1983 de Kanter ..... E21B 36/001 165/104.21
4,513,352 A * 4/1985 Bennett ..... H05K 7/20336 165/902
4,610,299 A * 9/1986 Hoover ..... H01L 23/4006 165/185
4,722,026 A * 1/1988 Bennett ..... H05K 5/0213 165/902

(Continued)

FOREIGN PATENT DOCUMENTS

EP 2362722 A1 8/2011
WO 2013076621 A1 5/2013

*Primary Examiner* — Anthony Haughton
*Assistant Examiner* — Razmeen Gafur
(74) *Attorney, Agent, or Firm* — Michael Dae

(57) ABSTRACT

An apparatus comprising a housing, a chassis, and a plurality of heat-generating components. The chassis is biased into contact with a plurality of locations along an inner surface of the housing in response to elastic deformation of the chassis. The chassis includes a plurality of substantially planar surfaces each interposing ones of the plurality of locations. The plurality of heat-generating components are directly coupled to corresponding ones of the plurality of substantially planar surfaces.

13 Claims, 5 Drawing Sheets

(56) References Cited

U.S. PATENT DOCUMENTS 5,701,751 A * 12/1997 Flores ..... E21B 47/011 165/104.21
6,880,647 B2 4/2005 Villareal
7,440,283 B1 * 10/2008 Rafie ..... E21B 47/011 165/185
7,568,521 B2 8/2009 Brown et al.
2006/0060964 A1 * 3/2006 Golla ..... E21B 47/011 257/712
2006/0101831 A1 * 5/2006 Storm ..... F28D 15/06 62/3.7
2006/0144619 A1 * 7/2006 Storm, Jr. ..... E21B 47/011 175/17
2010/0157536 A1 * 6/2010 Horng ..... H01L 21/4882 361/704
2011/0308791 A1 * 12/2011 Overmeyer ..... E21B 36/001 166/250.01
2012/0018230 A1 * 1/2012 Herrera ..... E21B 33/038 175/325.2
2013/0025886 A1 * 1/2013 Martinez ..... E21B 47/011 166/386
2013/0043077 A1 * 2/2013 Chen ..... E21B 7/04 175/61
2013/0090856 A1 * 4/2013 Godager ..... E21B 41/00 702/11
2013/0153246 A1 * 6/2013 Carrejo ..... E21B 43/08 166/381
2013/0180731 A1 * 7/2013 Acosta ..... E21B 23/06 166/386
2013/0213634 A1 * 8/2013 Edvardsen ..... B08B 1/02 166/84.1
2013/0233564 A1 * 9/2013 Pacey ..... E21B 34/14 166/373
2013/0255939 A1 * 10/2013 Kumaran ..... E21B 23/00 166/255.1
2013/0275100 A1 * 10/2013 Ellis ..... H04N 13/0203 703/2
2013/0299163 A1 * 11/2013 MacPhail ..... E21B 47/14 166/250.01
2013/0306328 A1 * 11/2013 Maguire ..... E21B 23/04 166/381
2013/0319685 A1 * 12/2013 Pike ..... E21B 41/00 166/378
2014/0146480 A1 * 5/2014 Ullo ..... E21B 47/011 361/719

* cited by examiner

HEAT TRANSFERRING ELECTRONICS CHASSIS

BACKGROUND OF THE DISCLOSURE

Wells are generally drilled into a land surface or ocean bed to recover natural deposits of oil and gas, as well as other natural resources that are trapped in geological formations in the Earth's crust. Testing and evaluation of completed and partially finished wellbores has become commonplace, such as to increase well production and return on investment. Information about the subsurface formations, such as measurements of the formation pressure, formation permeability, and recovery of formation fluid samples, may be useful for predicting the economic value, the production capacity, and production lifetime of a subsurface formation. Downhole tools, such as formation testers, may perform evaluations in real-time during sampling of the formation fluid.

These testing and evaluation operations have become increasingly expensive as wellbores are drilled deeper and through more difficult materials. In working with deeper and more complex wellbores, it becomes more likely that tool strings, tools, and/or other downhole apparatus may include numerous testing, navigation, and/or other tools, resulting in increasingly large tool strings that consume increasingly larger quantities of electrical power to drive or otherwise energize various internal components of such tool strings. As an increasingly larger amount of power is consumed, increasingly larger amount of heat may be generated by the various internal components of the downhole tool, substantially raising their temperature. Moreover, the heat generated by the internal components of the downhole tool may not be dissipated at a sufficient rate, resulting in internal temperatures exceeding functional temperature limits.

Downhole tools may also be subjected to a variety of loads, including but not limited to pressure differential, tension, compression, hydraulic force, torsion, bending, shock, and vibrations. Shock loads (e.g., sudden changes in acceleration) are especially damaging to internal electronic components, and may occur while the downhole tool is being operated downhole, transported, or otherwise handled. For example, a shock load may occur when the downhole tool collides with another object at a high velocity. Such shock loads may be transmitted to an internal support structure (e.g., a chassis) of the downhole tool, and the internal electronic components coupled thereto, through various mechanical interfaces between the internal support structure and an exterior housing of the downhole tool. Moreover, the shock loads imparted to the downhole tool housing may be amplified when transmitted to the internal support structure if there is a gap between the downhole tool housing and the internal support structure. Shock isolators or dampers, which are typically made of elastomers, plastics, and/or other non-metallic materials, may thus be incorporated in the downhole tool to mitigate such amplification and/or shock transmissibility. However, due to low thermal conductivities of non-metallic materials, such shock isolators provide a poor thermal path for transferring heat generated by the internal electronic components to the downhole tool housing for dissipation into the operating environment.

SUMMARY OF THE DISCLOSURE

This summary is provided to introduce a selection of concepts that are further described below in the detailed description. This summary is not intended to identify indispensable features of the claimed subject matter, nor is it intended for use as an aid in limiting the scope of the claimed subject matter.

The present disclosure introduces an apparatus that includes a housing, a chassis, and heat-generating components. The housing has an interior surface that is substantially cylindrical. The chassis is biased into contact with locations along the inner surface of the housing in response to elastic deformation of the chassis, and includes substantially planar surfaces each interposing ones of the locations. The heat-generating components are each directly coupled to one of the substantially planar surfaces.

The present disclosure also introduces a method that includes assembling a downhole tool by applying an external contracting force to a heat-transferring chassis to elastically deform the heat-transferring chassis from a first position encompassed by a first diameter to a second position encompassed by a second diameter. The heat-transferring chassis includes members each having a substantially planar surface to which a corresponding heat-generating component is coupled. The method also includes inserting the heat-transferring chassis into a housing of the downhole tool. The housing includes a substantially cylindrical inner surface having a third diameter that is substantially less than the first diameter and substantially greater than the second diameter. The method also includes removing the external contracting force such that the elastic deformation of the heat-transferring chassis urges the each of the members into contact with the inner surface of the housing.

The present disclosure also introduces an apparatus that includes a heat-transferring apparatus. The heat-transferring apparatus includes substantially planar members each flexibly connected with an adjacent one of the substantially planar members. Two adjacent ones of the substantially planar members are not connected and are movable toward and away from each other.

These and additional aspects of the present disclosure are set forth in the description that follows, and/or may be learned by a person having ordinary skill in the art by reading the materials herein and/or practicing the principles described herein. At least some aspects of the present disclosure may be achieved via means recited in the attached claims.

BRIEF DESCRIPTION OF THE DRAWINGS

The present disclosure is understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
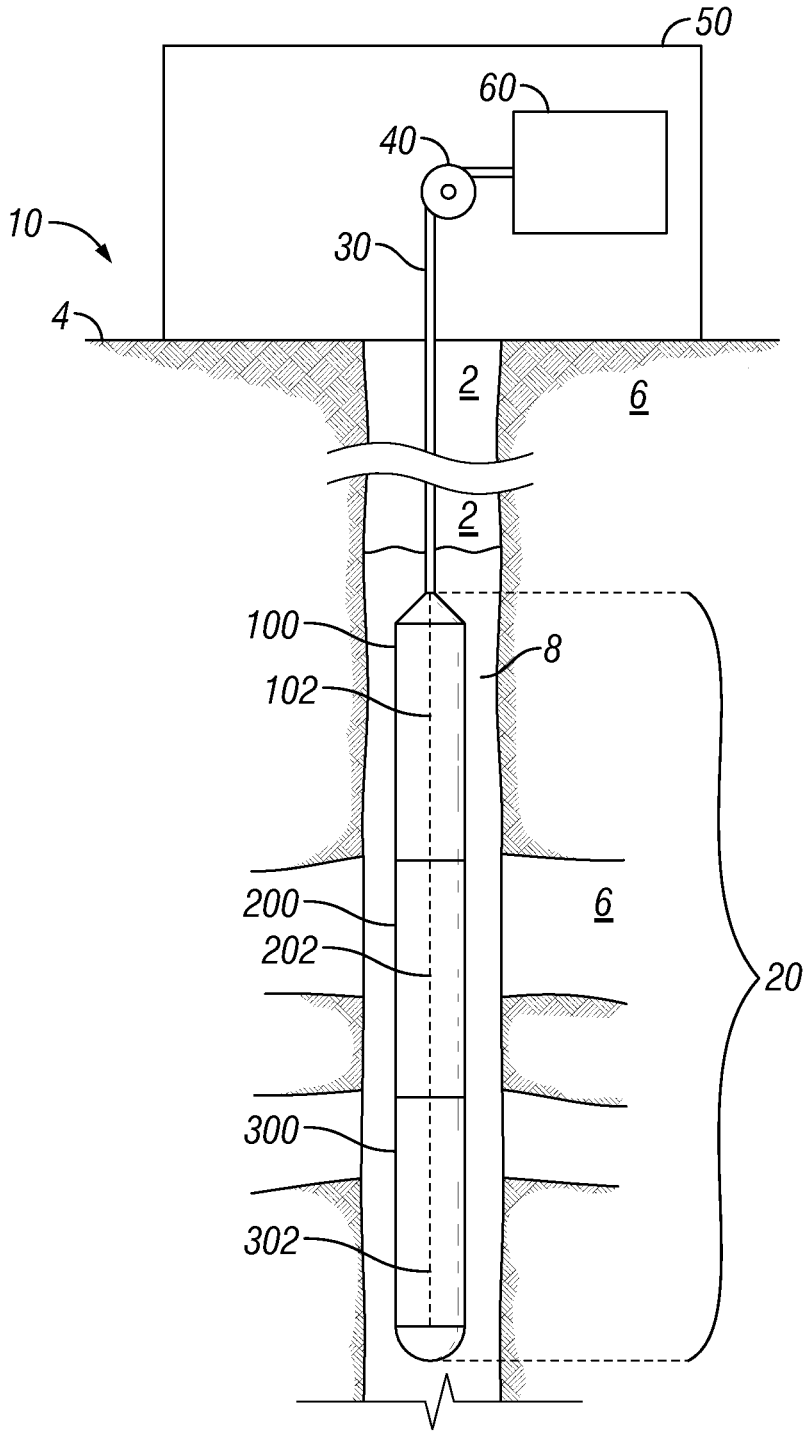
FIG. 1 is a schematic view of at least a portion of apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for simplicity and clarity, and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

FIG. 1 is a schematic view of at least a portion of a wellsite system 10 according to one or more aspects of the present disclosure. The wellsite system 10, which may be situated onshore or offshore, comprises a tool string 20 suspended within a wellbore 2 that extends from a wellsite surface 4 into one or more subterranean formations 6. The tool string 20 may comprise a first downhole module or tool 100, a second downhole module or tool 200 coupled with the first downhole tool 100, and a third downhole module or tool 300 coupled with the second downhole tool 200. The tool string 20 is shown suspended within the wellbore 2 via a conveyance means 30 operably coupled with a tensioning device 40 and/or another portion of surface equipment 50 disposed at the wellsite surface 4. The tool string may be disposed within a dry portion of the wellbore 2, or the tool string 20 may be submerged within a fluid 8, which may comprise water, wellbore fluid, drilling fluid ("mud"), formation fluid, and/or other fluids.

Although FIG. 1 depicts the tool string 20 comprising three downhole tools 100, 200, 300 coupled together, it should be understood that the tool string 20 may comprise a different number of downhole modules or tools, including one, two, four, or more downhole tools. Moreover, although FIG. 1 depicts the wellbore 2 as being an open-hole implementation lacking a casing and a cement sheath, it should be understood that one or more aspects of the present disclosure are also applicable to and/or readily adaptable for cased-hole implementations comprising such casing and cement sheath, among other implementations also within the scope of the present disclosure.

The tensioning device 40 may be operable to apply an adjustable tensile force to the tool string 20 in an uphole direction via the conveyance means 30. Although depicted schematically in FIG. 1, it should be understood that the tensioning device 40 may be, comprise, or form at least a portion of a crane, winch, drawworks, top drive, and/or other lifting device coupled to the tool string 20 by the conveyance means 30. The conveyance means 30 may be or comprise a wireline, slickline, e-line, coiled tubing, drill pipe, production tubing, and/or other conveyance means.

The conveyance means 30 may comprise and/or be operable in conjunction with a means for communication between the tool string 20, the tensioning device 40, a power and control system 60, and/or other portions of the surface equipment 50. For example, the conveyance means 30 may be a multi-conductor and/or other wireline cable extending between the tool string 20 and the surface equipment 50, including the power and control system 60. The power and control system 60 may include a source of electrical power and a surface controller having an interface operable to receive and process electrical signals from the tool string 20 and/or commands from a surface operator (not shown).

Each of the downhole tools 100, 200, 300 may comprise an electrical conductor 102, 202, 302, respectively, extending therethrough and electrically connected therewith. The electrical conductors 102, 202, 302 may connect with and/or form a portion of the conveyance means 30, thereby facilitating electrical communication between one or more of the downhole tools 100, 200, 300 and at least one component of the surface equipment 50, such as the power and control system 60. For example, the conveyance means 30 and the electrical conductors 102, 202, 302 may be operable to transmit electrical power, data, and/or control signals between the power and control system 60 and one or more of the downhole tools 100, 200, 300. The electrical conductors 102, 202, 302 may further facilitate electrical communication between two or more of the downhole tools 100, 200, 300, and may thus comprise various corresponding electrical connectors and/or interfaces (not shown).

The downhole tools 100, 200, 300 may each be or comprise at least a portion of one or more tools, modules, and/or other apparatus operable in wireline, while-drilling, coiled tubing, completion, production, and/or other operations. For example, the downhole tools 100, 200, 300 may each be or comprise at least a portion of an acoustic tool, a density tool, a directional drilling tool, a drilling tool, an electromagnetic (EM) tool, a gravity tool, a formation logging tool, a magnetic resonance tool, a formation measurement tool, a monitoring tool, a neutron tool, a nuclear tool, a photoelectric factor tool, a porosity tool, a reservoir characterization tool, a resistivity tool, a seismic tool, a surveying tool, a telemetry tool, a casing collar locator (CCL) tool, and/or a tough logging condition (TLC) tool, among other examples also within the scope of the present disclosure. Moreover, although not depicted in FIG. 1, one or more of the downhole tools 100, 200, 300 may comprise a probe assembly, an anchoring assembly, a sidewall-coring assembly, a pumping system, and/or other apparatus that may comprise one or more electrical motors and/or other electronic actuators, such as may be utilized while obtaining fluid and/or solid samples from the formation 6, among other example downhole operations also within the scope of the present disclosure.

Furthermore, one or more of the downhole tools 100, 200, 300 may comprise one or more sensors (not shown). For example, the one or more sensors may be operable for measuring, detecting, and/or otherwise determining one or more of pressure, temperature, composition, electric resistivity, dielectric constant, magnetic resonance relaxation time, nuclear radiation, and/or combinations thereof, although other types of sensors are also within the scope of the present disclosure. The one or more sensors may further comprise one or more of a spectrometer, a fluorescence sensor, an optical fluid analyzer, and/or a density and/or viscosity sensor, among other examples also within the scope of the present disclosure.

Moreover, although not depicted in FIG. 1, one or more of the downhole tools 100, 200, 300 may comprise a downhole controller and/or one or more other electrical components, such as may comprise one or more switches, including transistors and relays, resistors, transformers, drivers, amplifiers, processors, integrated circuit chips, and/or microelectromechanical system (MEMS) devices. The downhole controller and other electrical components may be communicatively coupled to the power and control system 60, whether via the conveyance means 30 and/or other telemetry means. The power and control system 60, in conjunction with the downhole controller and/or other electrical components of the downhole tools 100, 200, 300, may be operable to control at least portions of the downhole tools 100, 200, 300. For example, the power and control system 60, the downhole controller, and/or other electrical components may be operable to provide electrical power to and communicate with the electrical motor(s), pump(s), sensor(s), and/or other electrical and/or electro-mechanical components described above. The power and control system 60, the downhole controller, and/or other electrical components may also be operable to analyze and/or process data obtained from the sensors, store measurement and/or processed data, and/or communicate measurement and/or processed data. One or more of the downhole tools 100, 200, 300 may also comprise apparatus for storing electrical power, such as may comprise one or more batteries, capacitors, and/or inductors (not shown).

The downhole tools 100, 200, 300 may be similar in structure and/or function, at least with regard to one or more aspects described below. Therefore, the downhole tools 100, 200, 300 will be referred to hereinafter as "the downhole tool 100" for clarity, although aspects described below with reference to the downhole tool 100 may also be applicable or readily adaptable to the other downhole tools 200, 300.

Figure 2:
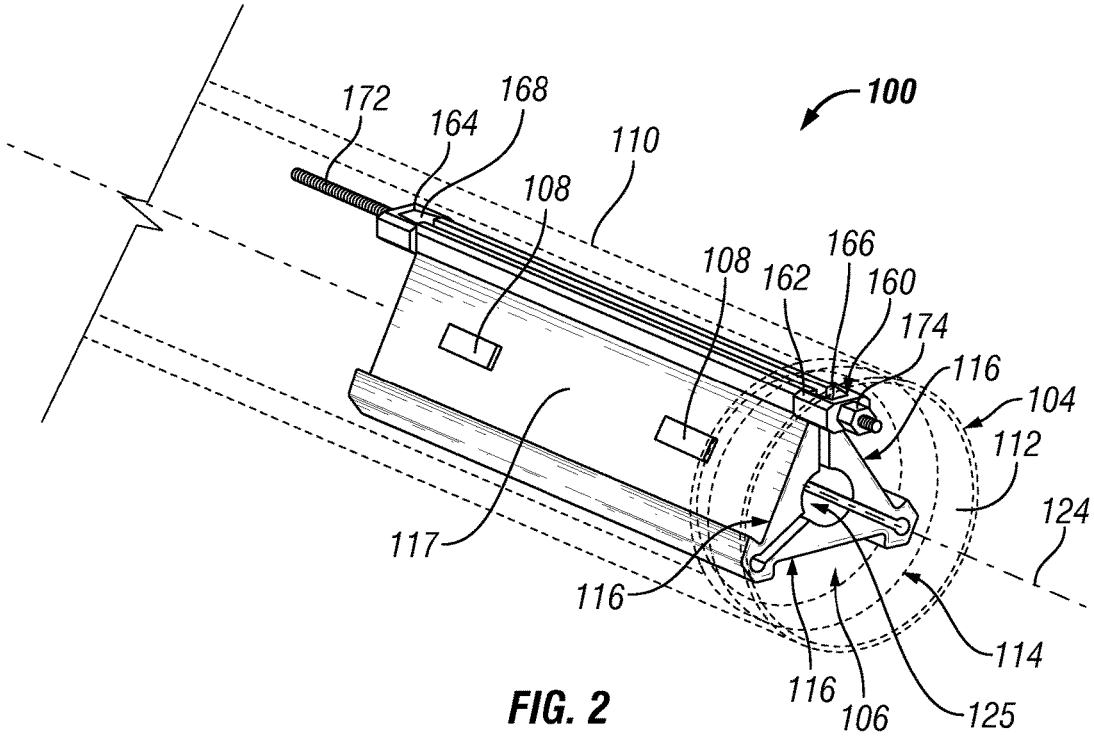
FIG. 2 is a perspective view of a portion of an example implementation of the apparatus shown in FIG. 1 according to one or more aspects of the present disclosure.
Figure 3:
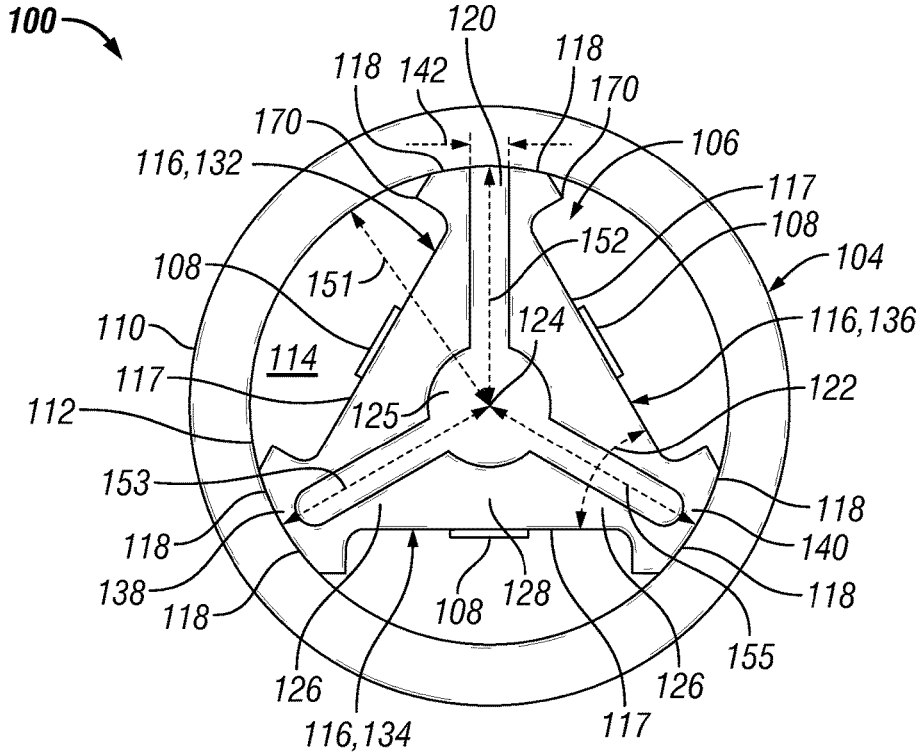
FIG. 3 is an end view of a portion of the apparatus shown in FIG. 2 according to one or more aspects of the present disclosure.

FIG. 2 is a perspective view of a portion of an example implementation of the downhole tool 100 shown in FIG. 1 according to one or more aspects of the present disclosure. FIG. 3 is an end view of the downhole tool 100 shown in FIG. 2 according to one or more aspects of the present disclosure. The following description refers to FIGS. 2 and 3, collectively.

Some apparatus, such as the tools, modules, sensors, pumps, motors, controllers, and other electrical components described above, may comprise portions and/or components that generate heat during operation. These heat-generating components (designated by reference numeral 108 in FIGS. 2 and 3), which include electrical and/or electronic components, may become overheated during operation and/or overheat other components within the downhole tool 100. Examples of these heat-generating components 108 include electrical components such as switches, relays, transistors, resistors, transformers, drivers, amplifiers, batteries, controllers, processors, integrated circuit chips, and microelectromechanical system (MEMS) devices, among other examples also within the scope of the present disclosure. However, as described below, the downhole tool 100 may comprise a heat-transferring apparatus 106 that may facilitate the transfer of heat away from the heat-generating components 108. FIG. 2 depicts the heat-transferring apparatus 106 during assembly into the downhole tool 100, and FIG. 3 depicted the heat-transferring apparatus 106 after such assembly into the downhole tool 100.

The downhole tool 100 comprises a housing 104, the heat-transferring apparatus 106, and the one or more heat-generating components 108 disposed on a surface of the heat-transferring apparatus 106. The one or more heat-generating components 108 may be coupled to the heat-transferring apparatus 106 via threaded fasteners, adhesive, solder, and/or other means. The housing 104 may be an external housing of the downhole tool 100, such as may be or comprise a substantially cylindrical tubular or other member having an outer surface 110 and an inner surface 112. Along at least a portion of the length of the housing 104, the inner surface 112 defines a substantially cylindrical central bore 114 extending longitudinally within the housing 104, within which the heat-transferring apparatus 106 may be disposed.

The heat-transferring apparatus 106, which may also be referred to herein as a chassis, comprises a plurality of members 116 each flexibly or pivotably connected with an adjacent member 116. Adjacent ones of some of the members 116 may be connected at predetermined angles 122 of less than 180 degrees. Each member 116 may comprise a substantially flat mounting surface 117, such as may be operable to receive thereon one or more of the heat-generating components 108. Thus, the members 116 may be considered substantially planar members, each comprising at least a portion resembling a structural plate or otherwise shaped feature. The members 116 and/or the mounting surfaces 117 may be disposed substantially symmetrically about a central axis 124 extending longitudinally through the heat-transferring apparatus 106. The members 116 and/or the mounting surfaces 117 may also face the inner surface 112 of the housing 104. The members 116 may collectively define a central passage 125 extending longitudinally through the heat-transferring apparatus 106.

The members 116 may each comprise one or more substantially cylindrical or otherwise shaped contact surfaces 118 at least partially defining outward ends or edges of each member 116. The contact surfaces 118 may extend longitudinally along the members 116 substantially parallel to the central axis 124. The contact surfaces 118 may contact the inner surface 112 of the housing 104 at a plurality of locations circumferentially spaced around the inner surface 112 of the housing 104.

Each member 116 may be flexibly or pivotably connected with an adjacent member 116 along or adjacent to their respective contact surfaces 118. Each member 116 may further comprise edge or outward portions 126 on opposing sides of a central or intermediate portion 128 comprising the mounting surface 117. Each intermediate portion 128 may be substantially thicker than the outward portions 126 in a radial direction, such that the outward portions 126 may elastically deform before (or instead of) deformation of the intermediate portion 128. Such implementations may aid in reducing or preventing the intermediate portion 128 and, therefore the mounting surface 117, from bending, flexing, or otherwise elastically deforming. Deformation of the mounting surface 117 may compromise the bonding or other coupling of the heat-generating component 108 to the mounting surface 117, or cause damage to the heat-generating component 108.

The members 116 may comprise a material, such as a metal, metal alloy, or a composite material, which may have elastic properties or be elastically deformable. The material forming the members 116 may include, for example, aluminum or an aluminum alloy (e.g., aluminum 6061), copper or a copper alloy (e.g., a beryllium-copper alloy), a magnesium alloy, steel, and/or another material comprising a thermal conductivity of not less than about 7.5 watts per meter kelvin (W/(m·° K)). It should be noted that members 116 comprising materials of higher thermal conductivity may transfer heat at a higher rate than members 116 comprising materials of lower thermal conductivity. The members 116 may also comprise an anodized metal or metal alloy, such as, for example, anodized aluminum. The metal or metal alloy may be anodized or painted, such as may increase thermal emissivity. For example, the metal or metal alloy may be anodized or painted in red. The inner surface 112 of the housing 104 may also be anodized, painted, and/or otherwise treated, such as may increase thermal emissivity.

The contact surfaces 118 may be in direct contact with the inner surface 112 of the housing 104, such that no elastomeric or other non-thermally conductive members are disposed between the heat-transferring apparatus 106 and the housing 104. However, the inner surface 112 of the housing 104 may be covered with a layer of material having high thermal conductivity, such as, for example, aluminum or an aluminum alloy (e.g., aluminum 6061), copper or a copper alloy (e.g., a beryllium-copper alloy), a magnesium alloy, and/or other materials, such as may improve contact between the inner surface 112 of the housing 104 and the contact surfaces 118 of the heat-transferring apparatus 106 and increase heat spreading along the housing 104. The inner surface 112 of the housing 104 and/or the contact surfaces 118 of the heat-transferring apparatus 106 may also or instead be at least partially coated with a thermal grease, gel, paste, tape, adhesive, and/or other thermal material that may aid in reducing thermal/contact resistance between the inner surface 112 and the contact surfaces 118. Such material may also or instead aid in reducing friction between the heat-transferring apparatus 106 and the housing 104, and/or otherwise facilitate installation and/or removal of the heat-transferring apparatus 106 into/from the housing 104.

As further shown in FIGS. 2 and 3, the heat-transferring apparatus 106 may comprise three members 116, which may be arranged in a triangular or delta-shaped configuration. In a triangular configuration, the angles 122 between the adjacent members 116 may be acute angles, such as in implementations in which the cumulative sum of the angles 122 may be about 180 degrees. However, although FIGS. 2 and 3 depict the heat-transferring apparatus 106 as comprising three members 116 arranged in a triangular configuration, the heat-transferring apparatus 106 may comprise another number of members 116, such as two, four, or more (not shown). For example, in implementations in which the heat-transferring apparatus 106 comprises four members 116, the angles 122 between adjacent pairs of the members 116 may be substantially right angles, and the cumulative sum of the angles 122 may be about 360 degrees. In implementations in which the heat-transferring apparatus 106 comprises five or more members 116, the angles 122 between adjacent pairs of the members 116 may be obtuse angles, with the cumulative sum of such angles 122 being more than 360 degrees.

Figure 4:
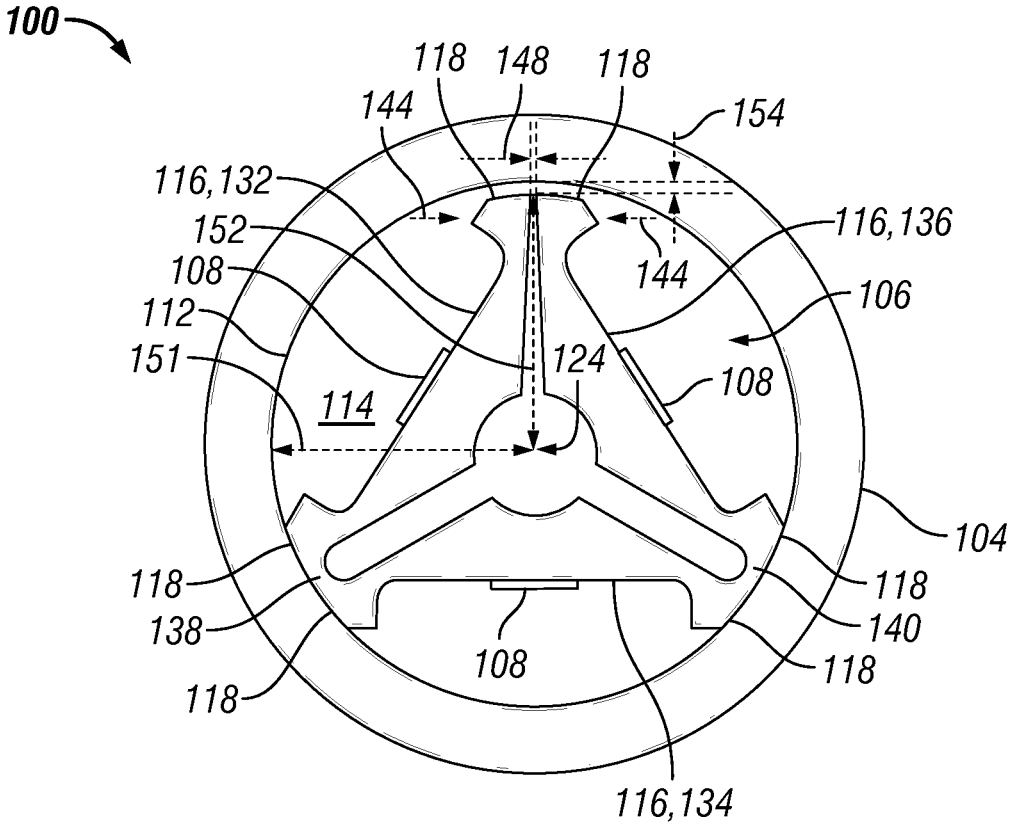
FIG. 4 is an end view of a portion of the apparatus shown in FIG. 2 according to one or more aspects of the present disclosure.

FIG. 4 is an end view of the downhole tool 100 shown in FIGS. 2 and 3 in a different stage of operation according to one or more aspects of the present disclosure. Referring to FIGS. 3 and 4, collectively, two of the members 116 are not directly connected, such that a gap or space 120 separates the two members 116 and permits relative movement of the members 116. For example, as shown in FIGS. 3 and 4, the members 116 include a first member 132, a second member 134, and a third member 136. The first member 132 is directly connected with the second member 134 by a connection, lobe, or other portion 138 (hereafter "connection 138"), such that the first and second members 132, 134 may pivot or otherwise move relative to each other about the connection 138 in response to the application of an external contracting force 144. Similarly, the second member 134 is directly connected with the third member 136 by a connection, lobe, or other portion 140 (hereafter "connection 140"), such that the second and third members 134, 136 may pivot or otherwise move relative to each other about the connection 140 in response to the application of the external contracting force 144. However, the first member 132 is not directly connected with the third member 136, such that proximate ends of the first and third members 132, 136 are separated by the space 120 and may move relative to each other in response to the application of the external contracting force 144. Thus, because the first and third members 132, 136 may pivot or otherwise move relative to the second member 134, the first and third members 132, 136 may pivot or otherwise move toward and away from each other.

For example, the first and third members 132, 136 may be pivotable or otherwise movable between a first position, depicted in FIG. 3, and a second position, depicted in FIG. 4. In the first position, the unconnected ends of the first and third members 132, 136 may be separated by the space 120 having a first distance 142 measured between the corresponding contact surfaces 118. For example, the first distance 142 may range between about 0.5 millimeters (mm) and about 1.5 mm, although other dimensions are also within the scope of the present disclosure. In the second position, the first and third members 132, 136 may be forced or otherwise moved toward each other by the external contracting force 144, as indicated in FIG. 4 by corresponding arrows. Accordingly, a second distance 148 that is substantially smaller than the first distance 142 may separate the first and third members 132, 136. For example, the second distance 148 may be less than about 0.5 mm, or the unconnected ends of the first and third members 132, 136 may contact each other (such that the second distance 148 is zero). Thus, the unconnected ends of the first and third members 132, 136 may be moved toward each other by overcoming an inherent stiffness or structural resistance of the heat-transferring apparatus 106, such as by elastically deforming the connections 138, 140, which creates a biasing force urging the first and third members 132, 136 away from each other toward the first position.

The inherent stiffness or structural resistance to movement of the members 116 is dependent upon, for example, the elasticity of the material forming of the heat-transferring apparatus 106 and/or the thickness of the connections 138, 140. These and/or other aspects may be selected such that the material stresses produced within the connections 138, 140 are maintained within an elastic stress range, so as to permit the first and third members 132, 136 to return to their natural position when the external contracting force 144 is released.

The heat-transferring apparatus 106 may be integrally formed as a single discrete member, such that each member 116 is connected to one or both adjacent members 116 at the connections 138, 140 also integrally formed with the members 116. The intermediate portion 128 of each member 116 may be substantially thicker than the maximum cross-sectional thickness of the connections 138, 140 in the radial direction, such that the heat-transferring apparatus 106 may bend, flex, or otherwise elastically deform a greater amount at the connections 138, 140 than at the intermediate portions 128 of the members 116. Accordingly, the first and third members 132, 136 may pivot relative to the second member 134 around the connections 138, 140.

Assembly of the downhole tool 100 includes inserting the heat-transferring apparatus 106 into the housing 104. However, when the first and third members 132, 136 are in their natural or free position, a position in which they are permitted to fully expand or move away from each other (to a degree greater than as shown in FIG. 3, such as where the space 120 is equal to or greater than about 1.5 mm), a first radial distance 152 extending between the central axis 124 and the contact surfaces 118 of the unconnected ends of the members 116 may be larger than a radius 151 of the inner surface 112 of the housing 104. For example, the first radial distance 152 may be at least 0.05 mm larger than the radius 151 of the inner surface 112. A second radial distance 153 extending between the central axis 124 and the contact surface(s) 118 at the connected ends of the first and second members 132, 134, and a third radial distance 155 extending between the central axis 124 and the contact surface(s) 118 of the second and third members 134, 136 may be the same as the first radial distance 152. Therefore, when the first and third members 132, 136 are in their natural or free position, the heat-transferring apparatus 106 may be encompassed by a diameter that is larger than a diameter of the inner surface 112 of the housing 104 by at least about 0.1 mm. For example, the interior surface 112 of the housing may have a first diameter (i.e., twice the radius 151), and a cross-sectional profile of the heat-transferring apparatus 106, when not elastically deformed, may be encompassed by a second diameter that is larger than the first diameter by at least about 0.1 mm. However, the dimensions described above are examples, and other dimensions are also within the scope of the present disclosure.

The first and third members 132, 136 may be forced toward each other by the external contracting force 144 to bend, flex, or otherwise elastically deform the heat-transferring apparatus 106 to reduce the size of the space 120 to less than the first distance 142, such as to the second distance 148, to facilitate insertion of the heat-transferring apparatus 106 into the housing 104. When the first and third members 132, 136 are thus moved closer together by the application of the external contracting force 144, the first radial distance 152 extending between the central axis 124 and the contact surfaces 118 of the unconnected ends of the first and third members 132, 136 is decreased, thus reducing the overall diameter of the heat-transferring apparatus 106 to be inserted into the housing 104.

For example, in the natural or free position, the first radial distance 152 may be larger than the radius 151 of the inner surface 112 of the housing. Thus, the external contracting force 144 may be applied to reduce the overall diameter of the heat-transferring apparatus 106, including moving the members 116 to the second position in which the first radial distance 152 is smaller than the radius 151 of the housing 104 by a second distance 154 that extends radially between the contact surfaces 118 of the unconnected ends of the first and third members 132, 136 and the inner surface 112 of the housing 104, thus permitting the heat-transferring apparatus 106 to be inserted into the housing 104. After the heat-transferring apparatus 106 is installed in the housing 104 and allowed to move to the first position (which is between the second position and the natural or free position), the first radial distance 152 is substantially the same as the radius 151 of the inner surface 112 of the housing 104. Thus, by reducing the overall profile or diameter of the heat-transferring apparatus 106, including the first radial distance 152, the heat-transferring apparatus 106 may be inserted into the bore 114 of the housing 104.

While the first and third members 132, 136 are in the second position, the heat-transferring apparatus 106 may be slid or otherwise inserted into the bore 114 of the housing 104 until the heat-transferring apparatus 106 is disposed in a predetermined position within the housing 104, as shown in FIG. 2. The predetermined position may be indicated by a shoulder (not shown) extending radially inward from the inner surface 112 of the housing 104. After the heat-transferring apparatus 106 is disposed in the predetermined position, the external contracting force 144 may be removed. Such removal permits the heat-transferring apparatus 106 to move toward the natural or free position until the contact surfaces 118 of the unconnected ends of the first and third members 132, 136 and the connections 138, 140 contact the inner surface 112 of the housing 104, including such that the first and third members 132, 136 expand away from each other to the first position, as depicted in FIG. 3.

The inner surface 112 of the housing 104 prevents the heat-transferring apparatus 106 from fully expanding to the uncompressed natural or free position, resulting in the contact surfaces 118 of the unconnected ends of the first and third members 132, 136 and the connections 138, 140 imparting an outwardly radial force against the inner surface 112 of the housing 104. The resulting average pressure (along the length of the heat-transferring apparatus 106) between the contact surfaces 118 and the inner surface 112 may range between about 0.1 megapascal (MPa) and about ninety percent of the material yield strength of the heat-transferring apparatus 106. For example, in implementations in which the heat-transferring apparatus 106 is formed from aluminum 6061, which has a yield strength of about 240 MPa, the average pressure between the contact surfaces 118 and the inner surface 112 may range between about 0.1 MPa and about 216 MPa (i.e., 90% of 240 MPa), although other pressures are also within the scope of the present disclosure. In at least one implementation within the scope of the present disclosure, the average pressure between the contact surfaces 118 and the inner surface 112 may be about 10 MPa, such as may aid in ensuring sufficient contact and thermal connectivity between the contact surfaces 118 and the inner surface 112.

The outwardly radial force may be sufficient to maintain the position of the heat-transferring apparatus 106 within the housing 104. The outwardly radial force may also aid in maintaining contact between the contact surfaces 118 and the inner surface 112 of the housing 104, such that heat generated by the one or more heat-generating components 108 may be conducted and/or otherwise transferred through the members 116 and connections 138, 140 to the housing 104. Thus, the heat-transferring apparatus 106 may form a thermal conduction path between each of the heat-generating components 108 and the housing 104. Thereafter, the heat may be transferred from the housing 104 into the ambient environment of the wellbore 2, as depicted in FIG. 1.

In addition, maintaining sufficient contact pressure between the housing 104 and the heat-transferring apparatus 106 may prevent the heat-transferring apparatus 106 from losing contact with the housing 104 when the downhole tool 100 is subjected to transverse shock loads. A transverse shock load resulting in the loss of contact between the housing 104 and the heat-transferring apparatus 106 may lead to high shock transmissibility, which may give rise to failures of the electronic components connected to the heat-transferring apparatus 106, including the heat-generating components 108.

FIG. 2 also depicts an example implementation of a retractor 160 operable to apply the external contracting force 144 to move the first and third members 132, 136 to the second position. The retractor 160 may comprise first and second opposing wedging members 162, 164, each having a V-shaped or otherwise inwardly sloping slot 166, 168 operable to receive therein lateral edges 170 and/or other portions of the first and third members 132, 136. The retractor 160 may further comprise a threaded rod 172 extending through both wedging members 162, 164 and first and second threaded fasteners 174 (the second fastener is blocked from view), which may retain the wedging members 162, 164 on the threaded rod 172. During operations, the wedging members 162, 164 may be disposed about the lateral edges 170 of the first and third members 132, 136, such that the lateral edges 170 are disposed within corresponding portions of the inwardly sloping slots 166, 168. The first threaded fastener 174 may then be rotated and, therefore translated against the first wedging member 162. As the first threaded fastener 174 translates along the threaded rod 172, the first threaded fastener 174 moves the wedging members 162, 164 toward each other, forcing the lateral edges 170 into the inwardly sloping slots 166, 168, which in turn, forces the first and third members 132, 136 toward each other. Once the first and third members 132, 136 are moved a predetermined distance, the heat-transferring apparatus 106 may be inserted into the central bore 114 of the housing 104 as described above. The first threaded fastener 174 may then be rotated in an opposite direction to release the first and third members 132, 136 and remove the retractor 160 from the housing 104. The retractor 160 shown in FIG. 2 and described above is merely an example implementation by which the heat-transferring apparatus 106 may be radially contracted for insertion into the housing 104, however, and other implementations are also within the scope of the present disclosure.

Figure 5:
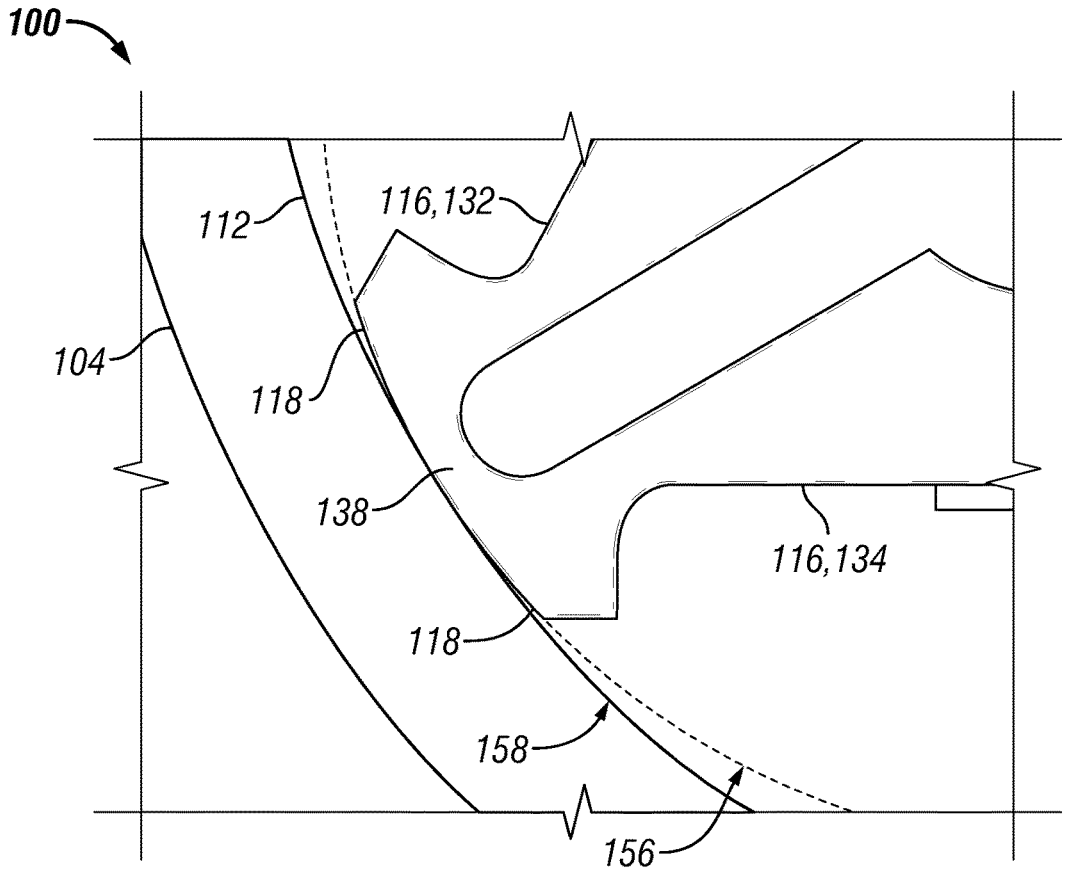
FIG. 5 is an enlarged view of a portion of the apparatus shown in FIG. 3 according to one or more aspects of the present disclosure.

FIG. 5 is an enlarged view of a portion of the apparatus shown in FIG. 3, demonstrating that the contact surfaces 118 of directly connected pairs of the members 116 (such as the connected ends of the first and second members 132, 134) may have a contact surface radius 156 that is slightly smaller than the radius 158 of the inner surface 112 of the housing 104. Implementations in which the contact surface radius 156 is slightly smaller than the radius 158 may aid in preventing central portions of the contact surfaces 118 from disengaging the inner surface 112 of the housing 104 when outer portions of the contact surfaces 118 are compressed against the inner surface 112, thereby forming spaces or gaps between the heat-transferring apparatus 106 and the housing 104. Such spaces or gaps may reduce thermal transfer between the heat-transferring apparatus 106 and the housing 104, and may trap air or other fluids between the heat-transferring apparatus 106 and the housing 104 that may lead to detrimental pressure differentials.

Figure 6:
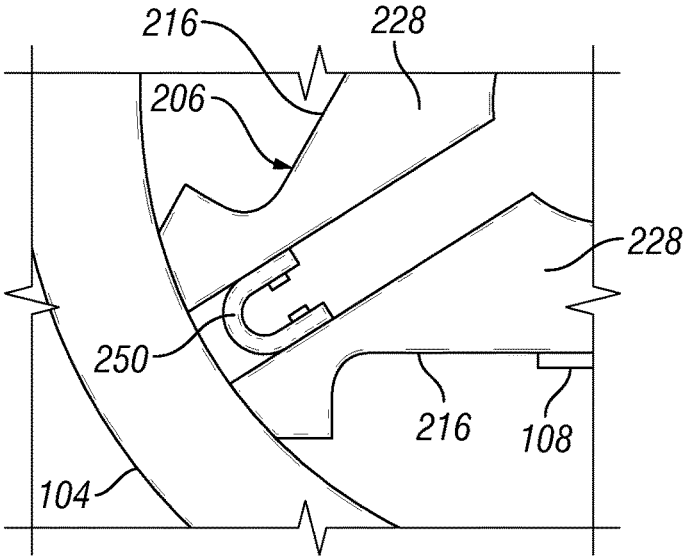
FIG. 6 is an end view of a portion of another example implementation of the apparatus shown in FIGS. 2-4 according to one or more aspects of the present disclosure.

FIG. 6 is an end view of a portion of another example implementation of the heat-transferring apparatus 106 shown in FIGS. 2-4, designated in FIG. 6 by reference numeral 206, according to one or more aspects of the present disclosure. The heat-transferring apparatus 206 shown in FIG. 6 is substantially similar to the heat-transferring apparatus 106 shown in FIGS. 2-4, with the following exceptions.

For example, the heat-transferring apparatus 106 shown in FIGS. 2-4 is depicted as a single discrete member, whereas the heat-transferring apparatus 206 is not formed as a single discrete member, but instead comprises a plurality of discrete members 216 flexibly connected by a plurality of discrete connectors 250. For example, the discrete connectors 250 may include leaf springs, torsion spring, hinges, or other connectors operable to connect and bias or urge the members 216 to move or pivot away from each other in a manner similar to as described above with respect to FIGS. 2-4. As with the example implementation shown in FIGS. 2-4 and described above, an intermediate portion 228 of each member 216 may be substantially thicker or otherwise more resistant to flexing, bending, and/or other deformation relative to each discrete connector 250. Accordingly, the heat-transferring apparatus 206 may bend, flex, or otherwise elastically deform a greater amount at the discrete connectors 250 than at the intermediate portions 228. Thus, the members 216 may pivot relative to each other, with the discrete connectors 250 acting as pivot points.

Figure 7:
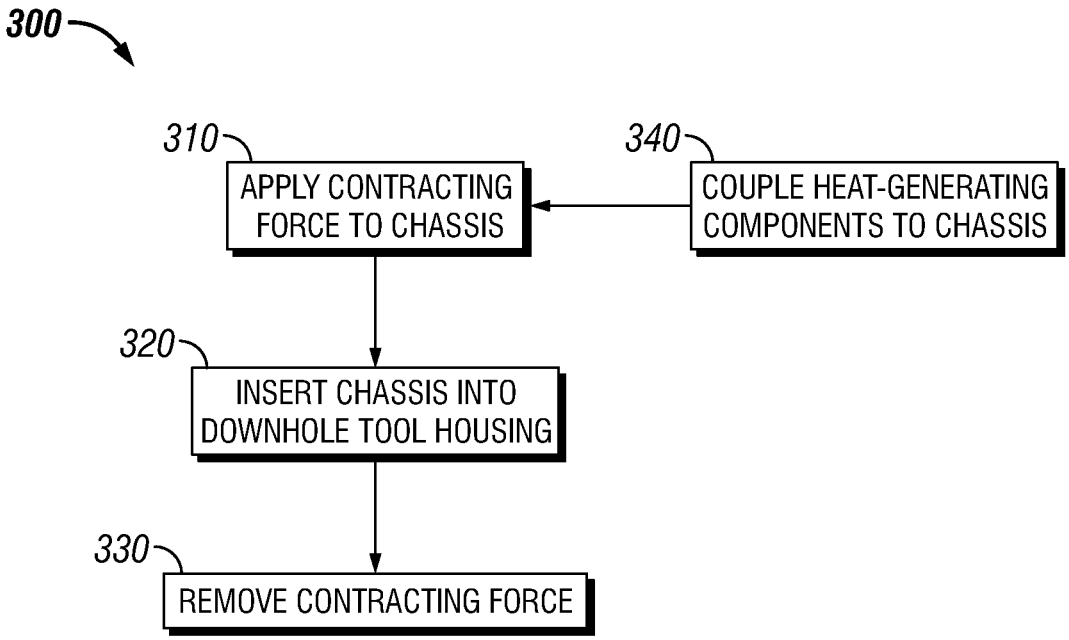
FIG. 7 is a flow-chart diagram of at least a portion of a method according to one or more aspects of the present disclosure.

FIG. 7 is a flow-chart diagram of at least a portion of an example implementation of a method (300) according to one or more aspects of the present disclosure. The method (300) may be utilized to assemble at least a portion of a downhole tool, such as at least a portion of the downhole tool shown in one or more of FIGS. 1-4. Thus, the following description refers to FIGS. 1-4 and 7, collectively.

The method (300) comprises applying (310) an external contracting force 144 to a heat-transferring chassis 106. Such application (310) of the external contracting force 144 elastically deforms the heat-transferring chassis 106 from a first position (referred to above as the natural or free position) encompassed by a first diameter to a second position (shown in FIG. 4) encompassed by a second diameter. As also described above, the heat-transferring chassis 106 comprises a plurality of members 116 each having a substantially planar surface 117 to which a corresponding one of a plurality of heat-generating components 108 is coupled.

The heat-transferring chassis 106 is then inserted (320) into a housing 104 of a downhole tool 100. The housing 104 comprises a substantially cylindrical inner surface 112 having a third diameter (i.e., twice the radius 151) that is substantially less than the first diameter and substantially greater than the second diameter.

The external contracting force 144 is then removed (330) such that the elastic deformation of the heat-transferring chassis 106 urges the each of the plurality of members 116 into contact with the inner surface 112 of the housing 104. Removing (330) the external contracting force 114 may thus establish a thermal conduction path between each of the plurality of heat-generating components 108 and the housing 104 via the heat-transferring chassis 106.

As described above, the plurality of members 116 may include a first member 132, a second member 134, and a third member 136, wherein the first and second members 132, 134 are directly connected, the second and third members 134, 136 are directly connected, and the first and third members 132, 136 are not directly connected and are separated by a space 120. Applying (310) the external contracting force 144 may comprise assembling a retractor 160 to unconnected ends of the first and third members 132, 136 to decrease the space 120, and removing (330) the external contracting force 144 may comprise disassembling the retractor 160 from the unconnected ends of the first and third members 132, 136. For example, as also described above, the retractor 160 may comprise first and second opposing wedging members 162, 164 each operable to receive therein the unconnected ends of the first and third members 132, 136, a threaded rod 172 extending through the first and second wedging members 162, 164, and first and second threaded fasteners 174 retaining the first and second wedging members 162, 164 on the threaded rod 172. In such implementations, applying (310) the external contracting force 144 comprises rotating one of the threaded fasteners 174 in a first rotational direction relative to the threaded rod 172 to decrease a distance 142 separating the first and second wedging members 162, 164, and removing (330) the external contracting force 144 comprises rotating the threaded fastener 174 in a second rotational direction relative to the threaded rod 172 to increase the distance 148 separating the first and second wedging members 162, 164.

The method (300) may also comprise, before applying (310) the external contracting force 144, coupling (340) each of the plurality of heat-generating components 108 to the substantially planar surface 117 of the corresponding one of the plurality of members 116. Such coupling (340) may be via threaded fasteners, adhesive, solder, and/or other means.

In view of the entirety of the present disclosure, including the figures and the claims, a person having ordinary skill in the art should readily recognize that the present disclosure introduces an apparatus comprising: a housing having an interior surface that is substantially cylindrical; a chassis biased into contact with a plurality of locations along the inner surface of the housing in response to elastic deformation of the chassis, wherein the chassis comprises a plurality of substantially planar surfaces each interposing ones of the plurality of locations; and a plurality of heat-generating components each directly coupled to one of the plurality of substantially planar surfaces. A thermal conductivity of the chassis may be not less than about 7.5 W/(m·° K).

The housing may be an external housing of a downhole tool operable for conveyance within a wellbore extending into a subterranean formation.

Each of the plurality of substantially planar surfaces may face the inner surface of the housing.

The interior surface may have a first diameter, and a cross-sectional profile of the chassis, when not elastically deformed, may be encompassed by a second diameter that is larger than the first diameter by at least about 0.1 mm.

The chassis may substantially comprise aluminum, anodized aluminum, and/or red-anodized aluminum. The chassis may comprise a central, longitudinal passage. The chassis may form a thermal conduction path between each of the plurality of heat-generating components and the housing. The chassis may be biased into contact with each of the plurality of locations along the inner surface of the housing by a pressure greater than about 50% of a material yield strength of the chassis.

The may comprise no elastomeric components interposing the chassis and the housing at the plurality of locations.

The chassis may be integrally formed as a single discrete member.

The chassis may comprise a plurality of members each extending longitudinally relative to a major dimension of the chassis, and each of the plurality of members may comprise a corresponding one of the plurality of substantially planar surfaces. A first one of the plurality of members and a second one of the plurality of members may be coupled by a first lobe, the second one of the plurality of members and a third one of the plurality of members may be coupled by a second lobe, and the first and third ones of the plurality of members may not be directly coupled. The first and third ones of the plurality of members may be separated by a circumferential gap and are movable toward and away from each other. The plurality of members may collectively have a substantially triangular configuration. Adjacent ones of the plurality of members may be disposed at an angle with respect to each other, and the sum of the angles between each pair of adjacent ones of the plurality of members may be about 180 degrees. Each of the plurality of members may comprise an intermediate portion interposing outward portions, and the intermediate portion may be substantially thicker than the outward portions.

Each of the plurality of heat-generating components may be an electrical component. The electrical component may be selected from the group of: a switch; a relay; a transistor; a resistor; a transformer; a driver; an amplifier; a battery; a controller; a processor; an integrated circuit chip; and a microelectromechanical system (MEMS) device, among others.

The apparatus may further comprise a thermally conductive material between the chassis and the housing at areas of contact between the chassis and the housing. The thermally conductive material may comprise a thermally conductive metal, composite material, elastomer, grease, paste, tape, and/or adhesive.

The present disclosure also introduces a method comprising: assembling a downhole tool by: applying an external contracting force to a heat-transferring chassis to elastically deform the heat-transferring chassis from a first position encompassed by a first diameter to a second position encompassed by a second diameter, wherein the heat-transferring chassis comprises a plurality of members each having a substantially planar surface to which a corresponding one of a plurality of heat-generating components is coupled; then inserting the heat-transferring chassis into a housing of the downhole tool, wherein the housing comprises a substantially cylindrical inner surface having a third diameter that is substantially less than the first diameter and substantially greater than the second diameter; and then removing the external contracting force such that the elastic deformation of the heat-transferring chassis urges the each of the plurality of members into contact with the inner surface of the housing.

The heat-transferring chassis may have a thermal conductivity of not less than about 7.5 W/(m·° K).

Removing the external contracting force such that each of the plurality of members contact the inner surface of the housing may establish a thermal conduction path between each of the plurality of heat-generating components and the housing.

Each of the plurality of heat-generating components may be an electrical component.

The method may further comprise, before applying the external contracting force, coupling each of the plurality of heat-generating components to the substantially planar surface of the corresponding one of the plurality of members.

The plurality of members may include a first member, a second member, and a third member. The first and second members may be directly connected, the second and third members may be directly connected, and the first and third members may not be directly connected and may be separated by a space. Applying the external contracting force may comprise assembling a retractor to unconnected ends of the first and third members to decrease the space. Removing the external contracting force may comprise disassembling the retractor from the unconnected ends of the first and third members. The retractor may comprise: first and second opposing wedging members each operable to receive therein the unconnected ends of the first and third members; a threaded rod extending through the first and second wedging members; and first and second threaded fasteners retaining the first and second wedging members on the threaded rod. Applying the external contracting force may comprise rotating the first threaded fastener in a first rotational direction relative to the threaded rod to decrease a distance separating the first and second wedging members, and removing the external contracting force may comprise rotating the first threaded fastener in a second rotational direction relative to the threaded rod to increase the distance separating the first and second wedging members.

The method may further comprise applying a thermally conductive material onto the inner surface of the housing and/or portions of the heat-transferring chassis before inserting the heat-transferring chassis into the housing. The thermally conductive material may comprise a thermally conductive metal, composite material, elastomer, grease, paste, tape, and/or adhesive.

The present disclosure also introduces an apparatus comprising: a heat-transferring apparatus comprising a plurality of substantially planar members, wherein each of the plurality of substantially planar members is flexibly connected with an adjacent one of the plurality of substantially planar members, and wherein two adjacent ones of the plurality of substantially planar members are not connected and are movable toward and away from each other.

Each of the plurality of substantially planar members may comprise a plurality of edges, each of the plurality of substantially planar members may be flexibly connected along at least one of the plurality of edges with an adjacent one of the plurality of substantially planar members along an adjacent at least one of the plurality of edges, and two adjacent ones of the plurality of edges may not be connected and may be movable toward and away from each other.

The plurality of substantially planar members may comprise: a first substantially planar member; a second substantially planar member; and a third substantially planar member. The first substantially planar member may be flexibly connected with the second substantially planar member, the second substantially planar member may be flexibly connected with the third substantially planar member, and the first and third substantially planar members may not be connected and may be movable toward and away from each other. The first substantially planar member may comprise a first edge and an opposing second edge, the second substantially planar member may comprise a first edge and an opposing second edge, the third substantially planar member may comprise a first edge and an opposing second edge, the first substantially planar member may be flexibly connected along its first edge with the second substantially planar member along its first edge, the second substantially planar member may be flexibly connected along its opposing second edge with the third substantially planar member along its first edge, and the opposing second edge of the first substantially planar member and the opposing second edge of the third substantially planar member may not be connected and may be movable toward and away from each other.

The plurality of substantially planar members may be disposed in a substantially triangular configuration.

Adjacent ones of the plurality of substantially planar members may be disposed at an angle with respect to each other, and the sum of the angles may equal about 180 degrees.

Flexibly connected may comprise pivotably connected, and the not connected ones of the plurality of substantially planar members may be pivotable toward and away from each other.

The not connected ones of the plurality of substantially planar members may be movable between a first and a second position, wherein in the first position the not connected ones of the plurality of substantially planar members may be separated by a first distance, wherein in the second position the not connected ones of the plurality of substantially planar members may be separated by a second distance that is substantially smaller than the first distance, and wherein in the second position the not connected ones of the plurality of substantially planar members may be biased to move away from each other.

Each of the plurality of substantially planar members may be disposed substantially symmetrically about a longitudinal axis of the heat-transferring apparatus, and each of the plurality of substantially planar members may extend substantially longitudinally along the longitudinal axis.

The heat-transferring apparatus may further comprise a plurality of connectors operable for flexibly connecting adjacent ones of the plurality of substantially planar members.

The heat-transferring apparatus may be integrally formed.

Each of the plurality of substantially planar members may comprise outward portions having a first thickness and an intermediate portion extending between the outward portions having a second thickness, wherein the second thickness may be substantially greater than the first thickness.

The heat-transferring apparatus may be operable for insertion into an opening defined by an inner surface of a tool, and each of the plurality of substantially planar members may be operable to contact the inner surface of the tool. The not connected ones of the plurality of substantially planar members may be biased to move away from each other into contact with the inner surface of the tool. Each of the plurality of substantially planar members may comprise a contact surface operable for contacting the inner surface of the tool, and each contact surface may extend substantially longitudinally with respect to the heat-transferring apparatus. The heat-transferring apparatus may conduct heat from a heat-generating component coupled to one of the plurality of substantially planar members to the tool. The heat-generating component may be an electrical component. The apparatus may further comprise a thermally conductive material covering the contact surface and/or at least a portion of the inner surface of the tool. The thermally conductive material may comprise a thermally conductive metal, composite material, elastomer, grease, paste, tape, and/or adhesive.

The foregoing outlines features of several embodiments so that a person having ordinary skill in the art may better understand the aspects of the present disclosure. A person having ordinary skill in the art should appreciate that they may readily use the present disclosure as a basis for designing or modifying other processes and structures for carrying out the same functions and/or achieving the same benefits of the embodiments introduced herein. A person having ordinary skill in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. §1.72(b) to permit the reader to quickly ascertain the nature of the technical disclosure. It is submitted with the understanding that it will not be used to interpret or limit the scope or meaning of the claims.

What is claimed is:

1. An apparatus, comprising:

a housing having an interior surface that is substantially cylindrical;

a chassis biased into contact with a plurality of locations along the inner surface of the housing in response to elastic deformation of the chassis, wherein the chassis comprises a plurality of substantially planar surfaces each interposing ones of the plurality of locations;

a plurality of heat-generating components each directly coupled to one of the plurality of substantially planar surfaces; and wherein the interior surface has a first diameter, and wherein a cross-sectional profile of the chassis, when not elastically deformed, is encompassed by a second diameter that is larger than the first diameter by at least about 0.1 mm.

2. The apparatus of claim 1 wherein a thermal conductivity of the chassis is not less than about 7.5 W/(m·° K).

3. The apparatus of claim 1 wherein the housing is an external housing of a downhole tool operable for conveyance within a wellbore extending into a subterranean formation.

4. The apparatus of claim 1 wherein the chassis forms a thermal conduction path between each of the plurality of heat-generating components and the housing.

5. The apparatus of claim 1 wherein the chassis is biased into contact with each of the plurality of locations along the inner surface of the housing by an average pressure, over a longitudinal length of the chassis, that ranges between about 0.1 MPa and about 90% of a material yield strength of the chassis.

6. The apparatus of claim 1 wherein the chassis is integrally formed as a single discrete member.

7. The apparatus of claim 1 wherein each of the plurality of heat-generating components is an electrical component.

8. An apparatus, comprising:

a housing having an interior surface that is substantially cylindrical;

a chassis biased into contact with a plurality of locations along the inner surface of the housing in response to elastic deformation of the chassis, wherein the chassis comprises a plurality of substantially planar surfaces each interposing ones of the plurality of locations;

a plurality of heat-generating components each directly coupled to one of the plurality of substantially planar surfaces;

wherein the chassis comprises a plurality of members each extending longitudinally relative to a major dimension of the chassis, and wherein each of the plurality of members comprises a corresponding one of the plurality of substantially planar surfaces; and wherein each of the plurality of members comprises an intermediate portion interposing outward portions, and wherein the intermediate portion is substantially thicker than the outward portions.

9. An apparatus, comprising:

a housing having an interior surface that is substantially cylindrical;

a chassis biased into contact with a plurality of locations along the inner surface of the housing in response to elastic deformation of the chassis, wherein the chassis comprises a plurality of substantially planar surfaces each interposing ones of the plurality of locations;

a plurality of heat-generating components each directly coupled to one of the plurality of substantially planar surfaces;

wherein the chassis comprises a plurality of members each extending longitudinally relative to a major dimension of the chassis, and wherein each of the plurality of members comprises a corresponding one of the plurality of substantially planar surfaces; and wherein a first one of the plurality of members and a second one of the plurality of members are directly coupled, wherein the second one of the plurality of members and a third one of the plurality of members are directly coupled, and wherein the first and third ones of the plurality of members are not directly coupled.

10. The apparatus of claim 9 wherein the first and third ones of the plurality of members are separated by a circumferential gap and are movable toward and away from each other.

11. An apparatus, comprising:

a heat-transferring apparatus comprising a plurality of substantially planar members, wherein each of the plurality of substantially planar members is flexibly connected with an adjacent one of the plurality of substantially planar members, and wherein two adjacent ones of the plurality of substantially planar members are not connected and are movable toward and away from each other; and wherein the plurality of substantially planar members comprises:

a first substantially planar member;

a second substantially planar member; and a third substantially planar member, wherein the first substantially planar member is flexibly connected with the second substantially planar member, wherein the second substantially planar member is flexibly connected with the third substantially planar member, and wherein the first and third substantially planar members are not connected and are movable toward and away from each other.

12. The apparatus of claim 11 wherein the heat-transferring apparatus is operable for insertion into an opening defined by an inner surface of a tool, wherein each of the plurality of substantially planar members is operable to contact the inner surface of the tool, and wherein the heat-transferring apparatus conducts heat from a heat-generating component coupled to one of the plurality of substantially planar members to the tool.

13. An apparatus, comprising:

a heat-transferring apparatus comprising a plurality of substantially planar members, wherein each of the plurality of substantially planar members is flexibly connected with an adjacent one of the plurality of substantially planar members, and wherein two adjacent ones of the plurality of substantially planar members are not connected and are movable toward and away from each other; and wherein the not connected ones of the plurality of substantially planar members are movable between a first and a second position, wherein in the first position the not connected ones of the plurality of substantially planar members are separated by a first distance, wherein in the second position the not connected ones of the plurality of substantially planar members are separated by a second distance that is substantially smaller than the first distance, and wherein in the second position the not connected ones of the plurality of substantially planar members are biased to move away from each other.

* * * * *